US009664209B2

(12) United States Patent
Kawasaki et al.

(10) Patent No.: US 9,664,209 B2
(45) Date of Patent: May 30, 2017

(54) CONTROL SYSTEM FOR HYBRID CONSTRUCTION MACHINE

(71) Applicant: KAYABA INDUSTRY CO., LTD., Tokyo (JP)

(72) Inventors: Haruhiko Kawasaki, Kanagawa (JP); Masahiro Egawa, Saitama (JP)

(73) Assignee: KYB Corporation, Tokyo (JP)

( * ) Notice: Subject to any disclaimer, the term of this patent is extended or adjusted under 35 U.S.C. 154(b) by 256 days.

(21) Appl. No.: 14/407,089

(22) PCT Filed: Aug. 5, 2013

(86) PCT No.: PCT/JP2013/071179
§ 371 (c)(1),
(2) Date: Dec. 11, 2014

(87) PCT Pub. No.: WO2014/027583
PCT Pub. Date: Feb. 20, 2014

(65) Prior Publication Data

US 2015/0176609 A1 Jun. 25, 2015

(30) Foreign Application Priority Data

Aug. 15, 2012 (JP) ..... 2012-180234

(51) Int. Cl.
*F15B 11/024* (2006.01)
*F15B 21/08* (2006.01)
(Continued)

(52) U.S. Cl.
CPC ..... *F15B 11/024* (2013.01); *E02F 9/2075* (2013.01); *E02F 9/2095* (2013.01);
(Continued)

(58) Field of Classification Search
CPC ..... E02F 9/2025; E02F 9/2075; E02F 9/2091; E02F 9/2095; E02F 9/2217; E02F 9/2235;
(Continued)

(56) References Cited

U.S. PATENT DOCUMENTS 8,467,934 B2 * 6/2013 Kawasaki ..... E02F 9/2075 701/36
2011/0010047 A1 1/2011 Kawasaki et al.

FOREIGN PATENT DOCUMENTS

JP 2003-074517 A 3/2003
JP 2008-157407 A 7/2008
JP 2009-235717 A 10/2009

* cited by examiner

*Primary Examiner* — Logan Kraft
(74) *Attorney, Agent, or Firm* — Rabin & Berdo, P.C.

(57) ABSTRACT

A control system for hybrid construction machine includes: an operation valve for operating a boom; a variable displacement type fluid pressure motor; a distribution mechanism adapted to adjust a flow to be distributed to the fluid pressure motor; a motor generator adapted to be rotated integrally with the fluid pressure motor; a variable displacement type assist pump adapted to be rotated integrally with the motor generator; a distribution mechanism control unit adapted to control the distribution mechanism; a tilt angle control unit adapted to control tilt angles of the fluid pressure motor and the assist pump; and a motor generator control unit adapted to maintain a rotation speed of the motor generator at a target rotation speed. The target rotation speed at the time of boom regeneration control is set to higher than the target rotation speed in a case where only an assist control is carried out.

5 Claims, 2 Drawing Sheets

(51) Int. Cl.

| | |
|---|---|
| ***F15B 21/14*** | (2006.01) |
| ***E02F 9/20*** | (2006.01) |
| ***E02F 9/22*** | (2006.01) |
| ***F01B 23/10*** | (2006.01) |

(52) U.S. Cl.

CPC ..... *E02F 9/2217* (2013.01); *E02F 9/2235* (2013.01); *E02F 9/2242* (2013.01); *E02F 9/2282* (2013.01); *E02F 9/2292* (2013.01); *E02F 9/2296* (2013.01); *F01B 23/10* (2013.01); *F15B 21/082* (2013.01); *F15B 21/14* (2013.01); *F15B 2011/0246* (2013.01); *F15B 2211/20507* (2013.01); *F15B 2211/20546* (2013.01); *F15B 2211/20576* (2013.01); *F15B 2211/3058* (2013.01); *F15B 2211/6658* (2013.01); *F15B 2211/7058* (2013.01); *F15B 2211/763* (2013.01); *F15B 2211/88* (2013.01)

(58) Field of Classification Search

CPC ..... E02F 9/2242; E02F 9/2282; E02F 9/2292; E02F 9/2296; F01B 23/10; F15B 11/024; F15B 21/082; F15B 21/14; F15B 2011/0246; F15B 2211/20507; F15B 2211/20546; F15B 2211/20553; F15B 2211/20576; F15B 2211/3058; F15B 2211/3116; F15B 2211/45; F15B 2211/6316; F15B 2211/6346; F15B 2211/6355; F15B 2211/6658; F15B 2211/7058; F15B 2211/7135; F15B 2211/7142; F15B 2211/763; F15B 2211/88

See application file for complete search history.

CONTROL SYSTEM FOR HYBRID CONSTRUCTION MACHINE

TECHNICAL FIELD

The present invention relates to a control system for a hybrid construction machine.

BACKGROUND ART

There is known a hybrid construction machine such as a power shovel with an engine and a motor generator. The hybrid construction machine generates electric power by rotating a generator by means of an excess output of the engine, and/or generates power by rotating the motor generator by means of energy discharged from an actuator. The power generated in this way is used to rotate the motor generator, and a hydraulic motor and the like are driven by means of the rotation of the motor generator.

JP2009-235717A discloses a control device of a hybrid construction machine in which a turning pressure of the turning motor is utilized as regeneration energy. This control device causes a fluid pressure motor to rotate by utilizing pressure of a fluid discharged from a boom cylinder at the time of lowering a boom or the turning pressure of the turning motor, thereby rotating a motor generator to generate electric power or actuating an assist pump coupled to the fluid pressure motor.

SUMMARY OF INVENTION

In the above control device, since the assist pump is used together with a main pump, the assist pump is not required for a large discharge amount and is used at a relatively low rotation speed. The motor generator regenerates energy from the boom cylinder. A regeneration flow rate (or a regeneration flow) from the boom cylinder is great. Thus, in order to regenerate more energy, there is a need for rotating the motor generator at a higher rotation speed.

However, in a case where a boom regeneration control of regenerating the energy from the boom cylinder and drive of the assist pump are carried out at the same time, a rotation speed required by the assist pump is low as described above. Thus, it is difficult to sufficiently increase the rotation speed of the motor generator. Therefore, it becomes difficult to sufficiently increase a lowering speed of the boom to a speed required by an operator at the time of lowering a boom in which the boom cylinder is contracted.

It is an object of the present invention to provide a control system for a hybrid construction machine capable of sufficiently increasing a lowering speed of a boom to a speed required by an operator at the time of lowering the boom while carrying out efficient energy regeneration.

According to an aspect of the present invention, there is provided a control system for a hybrid construction machine, including: an operation valve for operating a boom, the operation valve being adapted to control a boom cylinder; a variable displacement type of fluid pressure motor for regeneration, the fluid pressure motor being rotated by means of a return fluid discharged from the boom cylinder at the time of lowering the boom; a distribution mechanism adapted to adjust a flow rate to be distributed to the fluid pressure motor among the return fluid; a motor generator adapted to be rotated integrally with the fluid pressure motor; a variable displacement type of assist pump adapted to be rotated integrally with the motor generator; a distribution mechanism control unit adapted to control the distribution mechanism to maintain a lowering speed of the boom regulated in accordance with a switching amount of the operation valve; a tilt angle control unit adapted to control tilt angles of the fluid pressure motor and the assist pump; and a motor generator control unit adapted to maintain a rotation speed of the motor generator at a target rotation speed, wherein the target rotation speed at the time of boom regeneration control in which the fluid pressure motor is rotated by the return fluid is set to higher than the target rotation speed in a case where only an assist control of actuating the assist pump is carried out.

DESCRIPTION OF EMBODIMENTS

Hereinafter, an embodiment of the present invention will be described with reference to the accompanying drawings.

Figure 1:
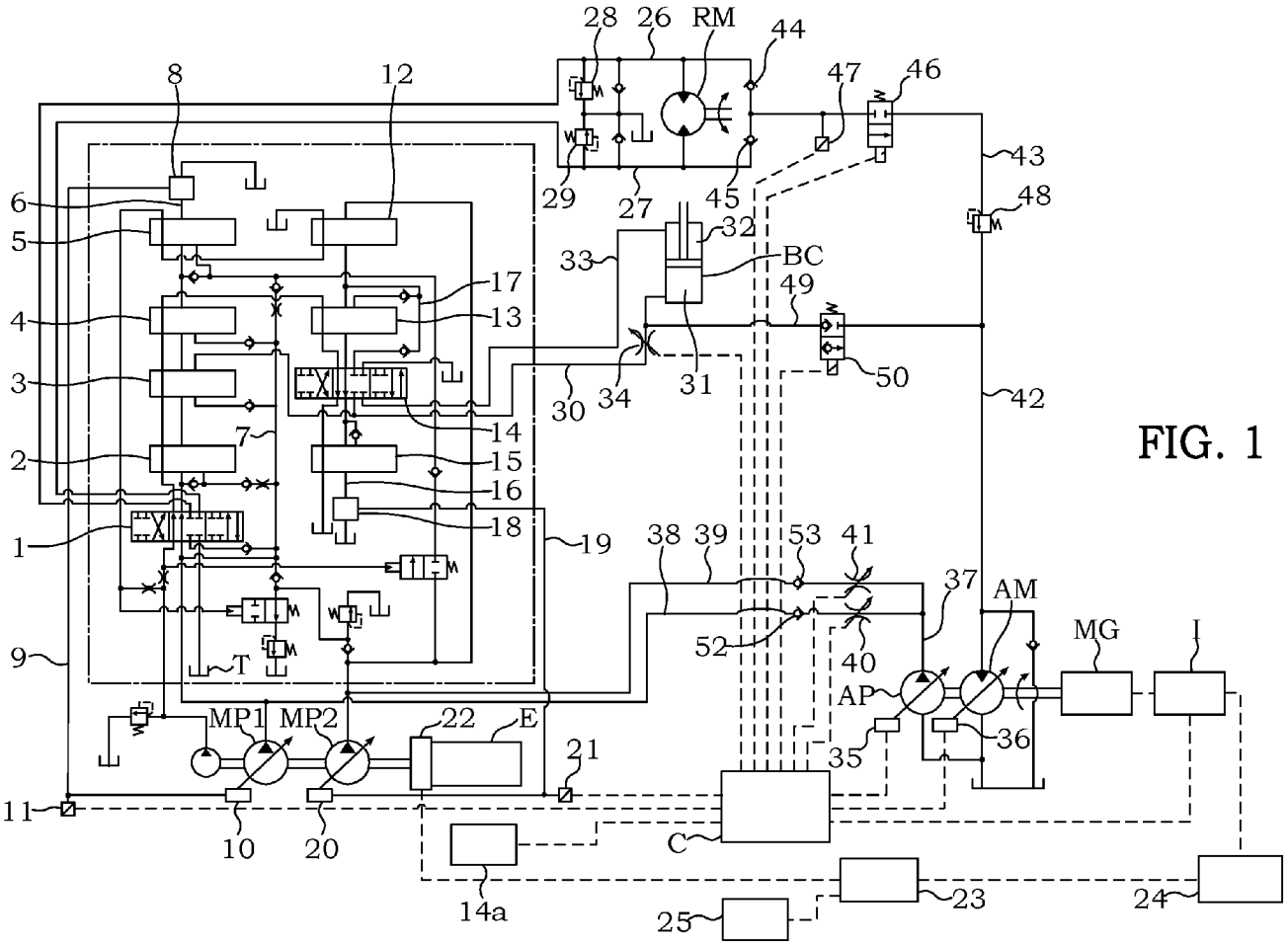
FIG. 1 is a circuit diagram showing a control system for a hybrid construction machine according to an embodiment of the present invention.

FIG. 1 is a circuit diagram showing a control system for a hybrid construction machine according to the present embodiment.

Although a power shovel is illustrated as a hybrid construction machine in the present embodiment, the hybrid construction machine may be another construction machine. The power shovel includes a variable displacement type of first main pump MP1, a variable displacement type of second main pump MP2, a first circuit system connected to the first main pump MP1, and a second circuit system connected to the second main pump MP2.

An operation valve 1 for a turning motor that is configured to control a turning motor RM; an operation valve 2 for arm first speed for controlling an arm cylinder (not shown in the drawings); an operation valve 3 for boom second speed for controlling a boom cylinder BC; an auxiliary operation valve 4 for controlling an auxiliary attachment (not shown in the drawings); and an operation valve 5 for a left traveling motor for controlling a left traveling motor (not shown in the drawings) are in turn connected to the first circuit system in order from an upstream side thereof.

Each of the operation valves 1 to 5 is connected to the first main pump MP1 via a neutral flow passage 6 and a parallel passage 7. A pilot pressure generating mechanism 8 is provided on the downstream side of the operation valve 5 for the left traveling motor in the neutral flow passage 6. The higher the pilot pressure generating mechanism 8 generates a pilot pressure at an upstream side thereof, the more a flow rate therethrough is.

Since the flow rate flowing through the pilot pressure generating mechanism 8 changes in accordance with switch amounts of the operation valves 1 to 5, the pilot pressure generating mechanism 8 generates the pilot pressure corresponding to the switch amounts of the operation valves 1 to 5.

In a case where all the operation valves 1 to 5 are at or in the vicinity of a neutral position, the neutral flow passage 6 guides all or part of fluid discharged from the first main pump MP1 to a tank T. In this case, the pilot pressure generating mechanism 8 generates a high pilot pressure since the flow rate passing through the pilot pressure generating mechanism 8 is high.

In a case where the operation valves 1 to 5 are switched, part of a pump discharge amount is guided to an actuator and the remaining amount is guided from the neutral flow passage 6 to the tank T. In this case, the pilot pressure generating mechanism 8 generates a pilot pressure corresponding to a flow rate (or a flow) flowing into the neutral flow passage 6.

In a case where each of the operation valves 1 to 5 is switched to a full stroke state, the neutral flow passage 6 is closed and no more fluid passes therein. In this case, the pilot pressure is kept at zero since there is no more flow rate flowing through the pilot pressure generating mechanism 8.

A pilot flow passage 9 is connected to the pilot pressure generating mechanism 8. The pilot flow passage 9 is connected to a regulator 10 for controlling a tilt angle of the first main pump MP1. The regulator 10 controls the tilt angle of the first main pump MP1 in inverse proportion to the pilot pressure in the pilot flow passage 9 to control a discharge amount of the first main pump MP1. Thus, when each of the operation valves 1 to 5 is switched to the full stroke state, there is no more flow in the neutral flow passage 6 and the pilot pressure generated by the pilot pressure generating mechanism 8 becomes zero. Therefore, the tilt angle of the first main pump MP1 becomes the maxim to maximize the discharge amount.

A first pressure sensor 11 is connected to the pilot flow passage 9. The first pressure sensor 11 inputs a detected pressure signal to a controller C.

On the other hand, an operation valve 12 for a right traveling motor that is adapted to control a right traveling motor (not shown in the drawings); an operation valve 13 for a bucket for controlling a bucket cylinder (not shown in the drawings); an operation valve 14 for boom first speed for controlling the boom cylinder BC; and an operation valve 15 for arm second speed for controlling the arm cylinder (not shown in the drawings) are in turn connected to the second circuit system in order from an upstream side thereof. A sensor 14*a* for detecting an operating direction and a switch amount is provided in the operation valve 14 for boom first speed.

Each of the operation valves 12 to 15 is connected to the second main pump MP2 via a neutral flow passage 16. Moreover, the operation valve 13 for the bucket and the operation valve 14 for boom first speed are connected to the second main pump MP2 via a parallel passage 17. A pilot pressure generating mechanism 18 is provided on the downstream side of the operation valve 15 for arm second speed in the neutral flow passage 16. The higher the pilot pressure generating mechanism 18 generates a pilot pressure at an upstream side thereof, the more a flow rate therethrough is.

A pilot flow passage 19 is connected to the pilot pressure generating mechanism 18. The pilot flow passage 19 is connected to a regulator 20 for controlling a tilt angle of the second main pump MP2. The regulator 20 controls the tilt angle of the second main pump MP2 in inverse proportion to the pilot pressure in the pilot flow passage 19 to control a discharge amount of the second main pump MP2. Thus, when each of the operation valves 12 to 15 is switched to the full stroke state, there is no more flow in the neutral flow passage 16 and the pilot pressure generated by the pilot pressure generating mechanism 18 becomes zero. Therefore, the tilt angle of the second main pump MP2 becomes the maxim to maximize the discharge amount.

A second pressure sensor 21 is connected to the pilot flow passage 19. The second pressure sensor 21 inputs a detected pressure signal to the controller C.

The first main pump MP1 and the second main pump MP2 are coaxially rotated by a driving force of one engine E. A generator 22 is coupled to the engine E. The generator 22 can generate electric power by being rotated by means of an excess output of the engine E. The electric power generated by the generator 22 is charged into a battery 24 via a battery charger 23. The battery charger 23 can charge electric power into the battery 24 even in a case where the battery charger 23 is connected to a household power source. That is, the battery charger 23 can also be connected to another power source independent of the power shovel. The battery 24 is connected to the controller C. The controller C has a function of monitoring a charge amount of the battery 24.

Passages 26, 27 communicating with the turning motor RM are respectively connected to actuator ports of the operation valve 1 for the turning motor, which is connected to the first circuit system. Relief valves 28, 29 are respectively connected to the passages 26, 27 as a turning circuit. In a case where the operation valve 1 for the turning motor is held at the neutral position as shown in FIG. 1, the actuator ports are closed and the turning motor RM is kept in a stopped state.

When the operation valve 1 for the turning motor is switched to a right position of FIG. 1, the passage 26 is connected to the first main pump MP1 and the passage 27 communicates with the tank T. Therefore, the fluid discharged from the first main pump MP1 is supplied to the turning motor RM via the passage 26 to rotate the turning motor RM. Moreover, the return fluid from the turning motor RM is returned to the tank T via the passage 27.

When the operation valve 1 for the turning motor is switched to a left position of FIG. 1, the fluid discharged from the first main pump MP1 is supplied to the turning motor RM via the passage 27 to rotate the turning motor RM in the opposite direction. Moreover, the return fluid from the turning motor RM is returned to the tank T via the passage 26.

When any of pressures in the passages 26, 27 becomes a set pressure during the rotation of the turning motor RM, the corresponding relief valve 28, 29 is opened to return the fluid at a high pressure side to the tank. Further, in a case where the operation valve 1 for the turning motor is returned to the neutral position during the rotation of the turning motor RM, the actuator ports of the operation valve 1 are closed. Even if the actuator ports of the operation valve 1 are closed, the turning motor RM continues to rotate for a while by inertial energy thereof. By the rotation of the turning motor RM due to the inertial energy, the turning motor RM exhibits a pump action. At this time, when a closed circuit is formed by the passages 26, 27, the turning motor RM and the relief valves 28, 29, the inertial energy is converted into thermal energy by means of the relief valves 28, 29.

In the present embodiment, when the pressures within the passages 26, 27 exceed the set pressures for opening the relief valves 28, 29 due to inertial energy during braking to stop the turning motor RM or a turning pressure during a turning movement, fluid in the turning circuit is supplied to a fluid pressure motor AM via a joint passage 43 (will be described later) instead of consuming the energy as thermal energy. In this way, a turning regeneration control is carried out. During the turning regeneration control, the controller C switches an electromagnetic on-off valve 46 provided in the joint passage 43 to an open position.

It should be noted that although the electromagnetic on-off valve 46 is provided in the joint passage 43 in the present embodiment, an on-off valve which is switched by the action of the pilot pressure may be provided instead of the electromagnetic on-off valve 46. In this case, a pilot electromagnetic control valve for controlling the pilot pressure may be provided newly. The pilot electromagnetic control valve is on-off controlled by a signal from the controller C.

When the operation valve 14 for boom first speed is switched from the neutral position to a right position of FIG. 1, the pressurized fluid from the second main pump MP2 is supplied to a piston-side chamber 31 of the boom cylinder BC by way of a passage 30. The return fluid from a rod-side chamber 32 is returned to the tank T by way of a passage 33. In this way, the boom cylinder BC is extended to raise a boom.

On the contrary, when the operation valve 14 for boom first speed is switched to a left position of FIG. 1, the pressurized fluid from the second main pump MP2 is supplied to the rod-side chamber 32 of the boom cylinder BC by way of the passage 33. The return fluid from the piston-side chamber 31 is returned to the tank T by way of the passage 30. In this way, the boom cylinder BC is contracted to lower the boom. It should be noted that the operation valve 3 for boom second speed is switched in conjunction with the operation valve 14 for boom first speed.

A return flow rate when the boom is lowered to contract the boom cylinder BC is determined by a switch amount of the operation valve 14 for boom first speed, and a lowering speed of the boom is determined by the return flow rate. That is, a contracting speed of the boom cylinder BC, i.e., the lowering speed of the boom is controlled in accordance with an operation amount when an operator operates a lever for switching the operation valve 14 for boom first speed.

A proportional electromagnetic valve 34 is provided in the passage 30 connecting the piston-side chamber 31 of the boom cylinder BC and the operation valve 14 for boom first speed. An opening degree of the proportional electromagnetic valve 34 is controlled by an output signal of the controller C, and the proportional electromagnetic valve 34 fully opens in a normal state.

Next, a variable displacement type of assist pump AP which assists outputs of the first main pump MP1 and the second main pump MP2 will be described.

A motor generator MG is coupled to the assist pump AP, and the fluid pressure motor AM is coupled to the motor generator MG. The assist pump AP is rotated by means of a driving force of the motor generator MG or a variable displacement type of fluid pressure motor AM, and the motor generator MG and the fluid pressure motor AM are coaxially rotated.

An inverter I is connected to the motor generator MG, and the inverter I is connected to the controller C. The controller C controls a rotation speed and the like of the motor generator MG via the inverter I. Tilt angles of the assist pump AP and the fluid pressure motor AM are respectively controlled by tilt angle controllers 35, 36. The tilt angle controllers 35, 36 are connected to the controller C and controlled by output signals of the controller C.

A discharge passage 37 is connected to the assist pump AP. The discharge passage 37 is branched off into a first joint passage 38 that joins a discharge side of the first main pump MP1 and a second joint passage 39 that joins a discharge side of the second main pump MP2. A first proportional electromagnetic throttle valve 40 and a second proportional electromagnetic throttle valve 41 whose openings are controlled by output signals of the controller C are respectively provided in the first joint passage 38 and the second joint passage 39.

A connection passage 42 is connected to the fluid pressure motor AM. The connection passage 42 is connected to the passages 26, 27, to which the turning motor RM is connected, via the joint passage 43 and check valves 44, 45. The electromagnetic on-off valve 46 on-off controlled by the controller C is provided in the joint passage 43. A pressure sensor 47 for detecting a turning pressure, which is a pressure at the time of turning the turning motor RM or a pressure at the time of braking the turning motor RM, is provided between the electromagnetic on-off valve 46 and the check valves 44, 45. A pressure signal of the pressure sensor 47 is inputted to the controller C.

A safety valve 48 is provided on the downstream side of the electromagnetic on-off valve 46 with respect to a flow from the turning circuit to the fluid pressure motor AM in the joint passage 43. The safety valve 48 prevents run-away of the turning motor RM by maintaining the pressures in the passages 26, 27 in a case where a member, such as the electromagnetic on-off valve 46, provided in a system including the connection passage 42 and the joint passage 43, for example. It should be noted that the pressure sensor 47, the electromagnetic on-off valve 46 and the safety valve 48 are in turn provided from an upstream side with respect to the flow from the turning circuit to the fluid pressure motor AM.

A passage 49 communicating with the connection passage 42 is provided between the boom cylinder BC and the proportional electromagnetic valve 34. An electromagnetic on-off valve 50 controlled by the controller C is provided in the passage 49. It should be noted although both the proportional electromagnetic valve 34 and the electromagnetic on-off valve 50 are provided in the present embodiment, the electromagnetic on-off valve 50 may be omitted if a flow passage switching mechanism or the like for preventing the return fluid of the boom cylinder BC from being guided to the fluid pressure motor AM is provided.

When the electromagnetic on-off valve 50 is switched to an open position, the return fluid from the boom cylinder BC is distributed into fluid to be guided to the fluid pressure motor AM and fluid to be guided to the tank from the operation valve 14 for boom first speed in accordance with the opening degree of the proportional electromagnetic valve 34.

The controller C computes the lowering speed of the boom cylinder BC required by the operator in accordance with an operation amount of the lever for operating the operation valve 14 for boom first speed of the boom cylinder BC when opening the electromagnetic on-off valve 50. The controller C determines the opening degree of the proportional electromagnetic valve 34 so that the lowering speed of the boom cylinder BC can be maintained on the basis of a total flow rate of the fluid to be guided to the fluid pressure motor AM and the fluid to be guided to the tank from the operation valve 14 for boom first speed.

A switch amount detecting unit (not shown in the drawings) for detecting an operation amount of a lever of each of the operation valves 1 to 5 and 12 to 15 is connected to the controller C. It should be noted that the switch amount detecting unit may be configured to detect the switch amount of the lever of each of the operation valves 1 to 5 and 12 to 15, or may be configured to directly detect a movement amount of a spool of each of the operation valves 1 to 5 and 12 to 15 or detect a pilot pressure to be applied to the spool.

Rotation speeds Nb, Na and Nr are stored in the controller C. The rotation speed Nb is a rotation speed of the motor generator MG during a boom regeneration control. The rotation speed Na is a rotation speed of the motor generator MG in the case of actuating only the assist pump AP without carrying out the boom regeneration control and the turning regeneration control. The rotation speed Nr is a rotation speed of the motor generator MG in the case of carrying out only the turning regeneration control without carrying out the boom regeneration control and in the case of carrying out both the turning regeneration control and an assist control.

A threshold value Pt of the turning pressure is stored in advance in the controller C. The threshold value Pt is a pressure slightly lower than the set pressures of the relief valves 28, 29 provided in the turning circuit of the turning motor RM, and is the pressure slightly lower than a brake pressure or a start-up pressure of the turning motor RM. In a case where the turning pressure detected by the pressure sensor 47 reaches the threshold value Pt, the controller C switches the electromagnetic on-off valve 46 from a closed position to an open position to supply the fluid to be discharged to the tank via the relief valves 28, 29 to the joint passage 43.

An arithmetic expression for computing a turning regeneration flow rate on the basis of the turning pressure and the threshold value of the turning pressure is stored in advance in the controller C. Thus, the controller C can predict the turning regeneration flow on the basis of the pressure detected by the pressure sensor 47 using this arithmetic expression.

It should be noted that the turning regeneration flow may be predicted by storing a table indicating a relationship between the pressure detected by the pressure sensor 47 and the turning regeneration flow in advance in the controller C and referring to the table. In this case, the controller C may not have an arithmetic function.

Figure 2:
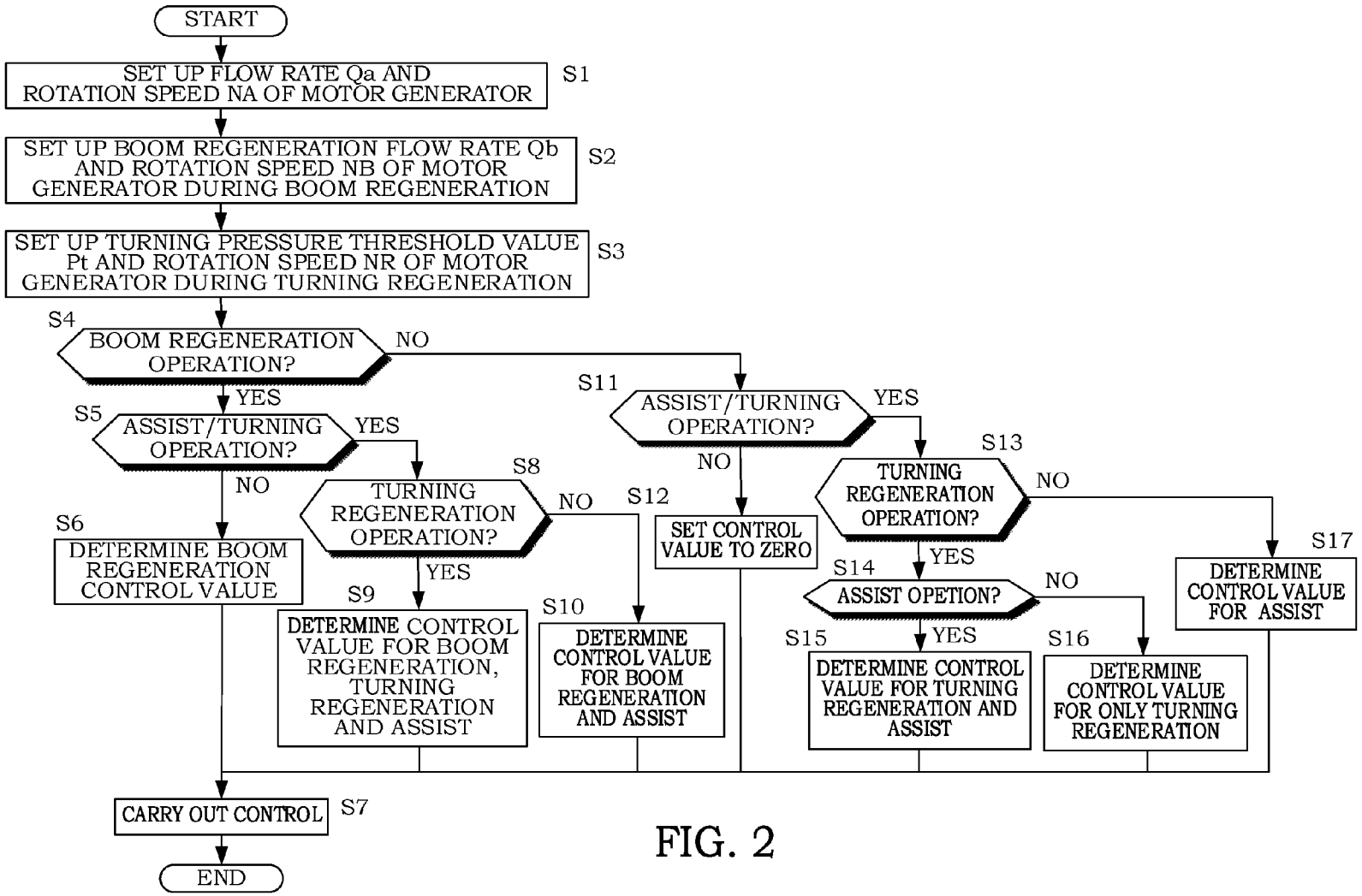
FIG. 2 is a flowchart showing the content of processing carried out by a controller.

Hereinafter, processing of the controller C during the boom regeneration control and the turning regeneration control will be described. FIG. 2 is a flowchart showing the content of the processing of the controller C.

At Step S1, the controller C sets up an assist flow rate Qa corresponding to an assist control command and the rotation speed Na of the motor generator MG stored in advance. The assist control command is a signal for actuating the assist pump AP. This signal is a signal inputted to the controller C from the switch amount detecting unit for detecting the switch amount of each of the operation valves in a case where the operation valve 14 for boom first speed is operated in a direction to extend the boom cylinder BC or any of the other operation valves 1, 2, 4, 5, 13 and 15 is operated. No assist control command is outputted in the case of carrying out only a boom lowering control in which the boom cylinder BC is contracted.

Namely, in a case where the operation valve is operated except during the boom lowering control, the controller C detects the switch amount of the operation valve and computes the assist flow rate Qa, which is a discharge amount of the assist pump, on the basis of an arithmetic expression set up in advance in the controller.

At Step S2, the controller C detects an extended or contracted state of the boom cylinder BC from an operation status of the operation valve 14 for boom first speed. During an operation to contract the boom cylinder BC, i.e., during the boom lowering control, the controller C computes a boom regeneration flow rate Qb on the basis of the switch amount of the operation valve 14 for boom first speed. Further, the controller C sets up the rotation speed Nb, stored in advance, of the motor generator MG during the boom regeneration control.

At Step S3, the controller C sets up the rotation speed Nr of the motor generator MG during the turning regeneration control and the threshold value Pt of the turning pressure. The rotation speed Nr and the threshold value Pt are stored in advance in the controller C. It should be noted that the setting of the rotation speed Na and the like by the controller C at Steps S1 to S3 means the setting of data necessary to control the operation valves and the tilt angle controllers 35, 36 connected to the controller C into a control program.

At Step S4, the controller C determines whether or not to carry out the boom regeneration control, i.e., whether there is a boom regeneration control command or not. The boom regeneration control command is a signal detected when an operation lever of a boom control valve contracts the boom cylinder BC, i.e., the boom cylinder BC is operated in a direction to lower the boom, and is inputted to the controller C from the switch amount detector. The processing proceeds to Step S5 in a case where it is determined that there is a boom regeneration control command. The processing proceeds to Step S11 in a case where it is determined that there is no boom regeneration control command.

At Step S5, the controller C determines whether there is at least one of the assist control command and the turning operation or not. Whether or not to actuate the assist pump AP is determined on the basis of presence or absence of the assist control command. Whether or not to actuate the turning motor RM is determined on the basis of presence or absence of an operation to switch the operation valve 1 for the turning motor.

The processing proceeds to Step S6 in a case where it is determined that there is no assist control command and the operation valve 1 for the turning motor has not been operated. The processing proceeds to Step S8 in a case where it is determined to actuate the assist pump AP or the turning motor RM.

At Step S6, the controller C computes a contracting speed of the boom cylinder BC (lowering speed of the boom), i.e., a return flow rate from the boom cylinder BC in accordance with the switch amount of the operation valve 14 for boom first speed. Moreover, the controller C switches the electromagnetic on-off valve 50 to the open position and controls the opening degree of the proportional electromagnetic valve 34 in accordance with the computed return flow rate.

Moreover, the controller C computes a control value for singly carrying out the boom regeneration control associated with extending and contracting movements of the boom cylinder BC. Specifically, the controller C computes the regeneration flow rate Qb guided to the connection passage 42 in accordance with the opening degree of the proportional electromagnetic valve 34, and computes a tilt angle $\beta$ of the fluid pressure motor AM at which the rotation speed of the motor generator MG can be maintained at the rotation speed Nb with this regeneration flow rate Qb. That is, the tilt angle $\beta$ is a tilt angle corresponding to a displacement per one rotation necessary to rotate the fluid pressure motor AM rotated by the regeneration flow rate Qb at the rotation speed Nb.

Moreover, the controller C sets the discharge amount of the assist pump AP to zero by setting a tilt angle $\alpha$ of the assist pump AP integrally rotating with the motor generator MG, which rotates at the rotation speed Nb, to zero.

In a case where it is determined to actuate the assist pump AP or the turning motor RM at Step S5 and the processing proceeds to Step S8, the controller C determines whether there is a turning regeneration control command or not. The turning regeneration control command is an input signal when the turning pressure detected by the pressure sensor 47, which is provided in the joint passage 43, reaches the threshold value Pt. The processing proceeds to Step S9 in a case where it is determined that there is a turning regeneration control command. The processing proceeds to Step S10 in a case where it is determined that there is no turning regeneration control command.

At Step S9, the controller C determines a control value for the boom regeneration control, the turning regeneration control and the assist control. Namely, the controller C computes the tilt angle β of the fluid pressure motor AM at which a value of the turning pressure detected by the pressure sensor 47 can be maintained to be the threshold value Pt while maintaining the rotation speed of the motor generator MG at the same rotation speed Nb as that when the boom regeneration control is singly carried out (Step S6).

Moreover, the controller C computes the tilt angle α of the assist pump AP at which the assist pump AP can discharge at the computed assist flow rate Qa while being rotated at the rotation speed Nb. This tilt angle α is a tilt angle corresponding to a displacement per one rotation necessary for the assist pump AP rotating at the rotation speed Nb to discharge at the assist flow rate Qa.

In a case where it is determined that there is no turning regeneration control command at Step S8 and the processing proceeds to Step S10, the controller C computes a control value for the boom regeneration control and the assist control without carrying out the turning regeneration control. Namely, the controller C computes the tilt angle β of the fluid pressure motor AM at which the rotation speed of the motor generator MG can be maintained at the set rotation speed Nb by means of the set regeneration flow rate Qb. Further, the controller C computes the tilt angle α of the assist pump AP at which the assist pump AP can discharge at the set assist flow rate Qa while being rotated at the rotation speed Nb.

In a case where it is determined that there is no boom regeneration control command at Step S4 and the processing proceeds to Step S11, the controller C determines presence or absence of the assist control command for actuating the assist pump AP and a rotational movement of the turning motor RM. In a case where it is determined that both the assist control command and the rotational movement are absent, the processing proceeds to Step S12 and the controller C sets the control value to zero.

In a case where it is determined that the assist control command or the rotational movement is present and the processing proceeds to Step S13, the controller C determines presence or absence of the turning regeneration control command. It is determined that the turning regeneration control command is present in a case where the turning pressure detected by the pressure sensor 47 has reached the threshold value Pt. It is determined that the turning regeneration control command is absent in a case where the turning pressure has not reached the threshold value Pt. The processing proceeds to Step S14 in a case where it is determined that the turning regeneration control command is present. The processing proceeds to Step S17 in a case where it is determined that the turning regeneration control command is absent.

At Step S14, the controller C determines presence or absence of the assist control command. The processing proceeds to Step S15 in a case where it is determined that the assist control command is present. The processing proceeds to Step S16 in a case where it is determined that the assist control command is absent.

At Step S15, the controller C computes a control value for carrying out the turning regeneration control and the assist control. The controller C computes the control value in a case where an operation other than the contracting movement of the boom cylinder BC (lowering movement of the boom) is carried out while the turning regeneration control is carried out.

Namely, the controller C computes the tilt angle β of the fluid pressure motor AM at which the turning pressure can be maintained to be the threshold value Pt while maintaining the rotation speed of the motor generator MG at the rotation speed Nr, and computes the tilt angle α of the assist pump AP at which the assist pump AP can discharge at the computed assist flow rate Qa.

Namely, the tilt angle α is a tilt angle corresponding to a displacement per one rotation necessary for the assist pump AP rotating at the rotation speed Nr to discharge at the assist flow rate Qa. The tilt angle β is a tilt angle required for maintaining the threshold value Pt while rotating the fluid pressure motor AM at the rotation speed Nr.

In a case where it is determined that the assist control command is absent at Step S14 and the processing proceeds to Step S16, the controller C computes the tilt angle β of the fluid pressure motor AM at which the turning pressure can be maintained to be the threshold value Pt while maintaining the rotation speed of the motor generator MG at the rotation speed Nr. Since the assist control is not necessary at this Step, the controller C sets the discharge amount of the assist pump AP to zero by setting the tilt angle α of the assist pump AP rotating at the rotation speed Nr to zero.

In a case where it is determined that the turning regeneration control command is absent at Step S13 and the processing proceeds to Step S17, the controller C computes a control value for only the assist control without carrying out the boom regeneration control and the turning regeneration control. Namely, the controller C computes the tilt angle α of the assist pump AP at which the assist pump AP can discharge at the assist flow rate Qa while maintaining the rotation speed Na of the motor generator MG. Since the boom regeneration control and the turning regeneration control are not carried out at this Step, the controller C sets the tilt angle β of the fluid pressure motor AM to zero.

After the computation of the control value according to each control at Steps S6, S9, S10, S15, S16 and S17 described above is terminated, the processing proceeds to Step S7.

At Step S7, the controller C confirms whether or not the flow rate and the rotation speed set at each Step are within a power limit of the motor generator MG, and carries out the control(s) corresponding to the above control value(s) in a case where they are within the power limit. Further, in a case where they are outside the power limit, the flow rate and the rotation speed are corrected to fall within the power limit and the control(s) corresponding to the above control value (s) is/are carried out.

It should be noted that the controller C also controls the proportional electromagnetic valve 34, the electromagnetic on-off valve 50 and the electromagnetic on-off valve 46 in addition to the tilt angles of the fluid pressure motor AM and the assist pump AP when to carry out the above controls.

For example, in a case where the boom regeneration control command is inputted, the controller C closes the proportional electromagnetic valve 34 and switches the electromagnetic on-off valve 50 to the open position to guide the regeneration flow from the boom cylinder BC to the connection passage 42. Further, in a case where the turning regeneration control command is inputted, the controller C switches the electromagnetic on-off valve 46 in the joint passage 43 to the open position to guide the fluid discharged from the turning motor RM to the connection passage 42.

In a control circuit of the present embodiment, when the turning pressure of the turning circuit reaches the threshold value Pt slightly lower than the brake pressure set up in the relief valves 28, 29, the electromagnetic on/off valve 46 of the joint passage 43 is switched to the opened position and the fluid of the turning circuit is thus guided to the fluid pressure motor AM. Therefore, the turning pressure can be prevented from reaching the brake pressure, and this makes it possible to prevent the fluid of the turning circuit from flowing into the tank T via the relief valves 28, 29. This makes it possible to regenerate the energy by guiding the fluid returned to the tank T via the relief valves 28, 29 to the fluid pressure motor AM.

In the present embodiment, the return flow can be supplied to the fluid pressure motor AM without being wasted since the motor generator MG is rotated at the rotation speed Nb, which is a relatively high rotation speed, during the boom regeneration control in which the return flow increases.

In the case of carrying out only the assist control or the case of carrying out only the turning regeneration control, the rotation speed of the motor generator MG is set up to the rotation speed Na, Nr lower than the rotation speed Nb. The rotation speeds Na, Nr are set lower in this way for the following reason.

Since the assist pump AP is used together with the first main pump MP1 and the second main pump MP2, it needs not have a very large discharge amount. For that reason, the tilt angle $\alpha$ of the assist pump AP is often controlled to be a small angle.

In a case where an attempt is made to control the discharge amount of the assist pump AP within a minute range by increasing the rotation speed of the motor generator MG in a state where the tilt angle $\alpha$ is small, a control range of the tilt angle $\alpha$ also becomes minute. In a case where an attempt is made to control the tilt angle $\alpha$ within a minute control range, it becomes difficult to control the discharge amount of the assist pump AP and pump efficiency of the assist pump AP decreases.

Accordingly, by setting the rotation speed Na in the case of carrying out only the assist control to low, it becomes easier to control the discharge amount of the assist pump AP and pump efficiency of the assist pump AP is improved.

Further, since the turning regeneration flow is low, the flow rate supplied to the fluid pressure motor AM decreases in the case of carrying out only the turning regeneration control. For that reason, a control range of the tilt angle $\beta$ of the fluid pressure motor AM can be widened by setting the rotation speed Nr of the motor generator MG in the case of carrying out only the turning regeneration control to low.

On the other hand, in the case of simultaneously carrying out the boom regeneration control and the assist control or the turning regeneration control, the rotation speed of the motor generator MG is set to the relatively high rotation speed Nb because priority is given to the boom regeneration control.

It should be noted that each of the rotation speed Na during the assist control and the rotation speed Nr during the turning regeneration control may be set to that lower than the rotation speed Nb during the boom regeneration control. Any one of the rotation speed Na and the rotation speed Nr may be higher than the other or both may be equal.

The embodiment of the present invention has been described above, but the above embodiment is merely examples of applications of the present invention, and the technical scope of the present invention is not limited to the specific configurations of the above embodiment.

The present application claims priority based on Japanese Patent Application No. 2012-180234 filed with the Japan Patent Office on Aug. 15, 2012, the entire content of which is incorporated into this specification.

The invention claimed is:

1. A control system for a hybrid construction machine, comprising:

an operation valve for operating a boom, the operation valve being adapted to control a boom cylinder;

a variable displacement type of a fluid pressure motor for regeneration, the fluid pressure motor being rotated by means of a return fluid discharged from the boom cylinder at the time of lowering the boom;

a distribution mechanism adapted to adjust a flow rate of the return fluid to be distributed to the fluid pressure motor;

a motor generator adapted to be rotated integrally with the fluid pressure motor;

a variable displacement type of assist pump adapted to be rotated integrally with the motor generator;

a distribution mechanism control unit adapted to control the distribution mechanism to maintain a lowering speed of the boom regulated in accordance with an opening amount of the operation valve;

a tilt angle control unit adapted to control tilt angles of the fluid pressure motor and the assist pump; and a motor generator control unit adapted to maintain a rotation speed of the motor generator at a predetermined target rotation speed, and set the predetermined target rotation speed to a first target rotation speed when the boom regeneration control, in which the fluid pressure motor is rotated by the return fluid, is performed, and to a second target rotation speed higher than the first target rotation speed only when assist control of actuating the assist pump is carried out.

2. The control system for the hybrid construction machine according to claim 1, further comprising:

a return flow computing unit adapted to compute a return flow on the basis of the opening amount of the operation valve at the time of the boom regeneration control, the return flow being a flow of the return fluid;

a regeneration flow computing unit adapted to compute a boom regeneration flow, the boom regeneration flow being a flow to be distributed to the fluid pressure motor by means of the distribution mechanism among the return flow; and a motor tilt angle computing unit adapted to compute a tilt angle of the fluid pressure motor required for the motor generator to maintain the predetermined target rotation speed at the time of the boom regeneration control on the basis of the boom regeneration flow, wherein the tilt angle control unit controls the tilt angle of the fluid pressure motor on the basis of the tilt angle calculated by the motor tilt angle computing unit.

3. The control system for the hybrid construction machine according to claim 1, further comprising:

an assist flow computing unit adapted to calculate an assist flow in a case where only the assist control is carried out, the assist flow being a discharge amount of the assist pump; and a pump tilt angle computing unit adapted to compute, on the basis of the assist flow, a tilt angle of the assist pump required for the motor generator to maintain the predetermined target rotation speed in a case where only the assist control is carried out, wherein the tilt angle control unit controls the tilt angle of the assist pump on the basis of the tilt angle computed by the pump tilt angle computing unit.

4. The control system for the hybrid construction machine according to claim 1, further comprising:

a turning circuit connected to the fluid pressure motor via a joint passage, the joint passage joining a passage that connects the boom cylinder to the fluid pressure motor;

a turning motor provided in the turning circuit;

a pressure detector adapted to detect a turning pressure of the turning motor; and a turning regeneration determining unit adapted to determine that it is the time of turning regeneration control in which the fluid pressure motor is rotated by means of a fluid guided from the turning circuit to the fluid pressure motor in a case where the turning pressure detected by the pressure detector reaches a threshold value Pt set up in advance, wherein the predetermined target rotation speed in a case of determining that it is the time of the turning regeneration control is set to a third target rotation speed lower than the first target rotation speed at the time of the boom regeneration control.

5. The control system for the hybrid construction machine according to claim 4, further comprising:

a tilt angle computing unit adapted to compute a tilt angle of the fluid pressure motor required to maintain the turning pressure to the threshold value Pt while maintaining the rotation speed of the motor generator at the third target rotation speed at the time of the turning regeneration control in a case of determining that it is the time of the turning regeneration control, wherein the tilt angle control unit controls the tilt angle of the fluid pressure motor on the basis of the tilt angle computed by the tilt angle computing unit.

* * * * *